US005310424A

United States Patent [19]

Taylor

[11] Patent Number: 5,310,424

[45] Date of Patent: May 10, 1994

[54] PROCESS FOR REDUCING THE FIBRILLATION TENDENCY OF SOLVENT-SPUN CELLULOSE FIBRE

[75] Inventor: James M. Taylor, Derby, United Kingdom

[73] Assignee: Courtaulds PLC, London, United Kingdom

[21] Appl. No.: 863,008

[22] Filed: Apr. 6, 1992

[30] Foreign Application Priority Data

Oct. 21, 1991 [GB] United Kingdom ..... 9122318

[51] Int. Cl.[5] ..... D06M 13/322

[52] U.S. Cl. ..... 8/190; 8/189; 8/549

[58] Field of Search ..... 8/549, 189, 190

[56] References Cited

U.S. PATENT DOCUMENTS

| | | |
|---|---|---|
| 2,394,306 | 2/1946 | Hentrich et al. . |
| 3,383,443 | 5/1968 | Leahy et al. . |
| 3,883,523 | 5/1975 | Parton . |
| 4,246,221 | 1/1981 | McCorsley, III . |
| 4,416,698 | 11/1983 | McCrosley, III . |
| 4,563,189 | 1/1986 | Lewis . |

FOREIGN PATENT DOCUMENTS

| | | |
|---|---|---|
| 0118983 | 9/1984 | European Pat. Off. . |
| 0174794 | 3/1986 | European Pat. Off. . |
| 2108069 | 5/1972 | France . |
| 2273091 | 4/1977 | France . |
| WO92/07124 | 4/1992 | PCT Int'l Appl. . |
| 734974 | 8/1955 | United Kingdom . |
| 878655 | 10/1961 | United Kingdom . |
| 950073 | 2/1964 | United Kingdom . |
| 1271518 | 4/1972 | United Kingdom . |
| 2043525 | 10/1980 | United Kingdom . |

OTHER PUBLICATIONS

R. W. Moncrieff, 6th Edition, "Man-Made Fibres", 6:882-895, 900-925 (1975).

"Textile Resins" in Encyclopedia of Polymer Science and Technology, 16:682699 (1989).

"Dyeing" in Encyclopedia of Polymer Science and Engineering, 5:226-245 (1986).

S. V. Kulkami et al, "Textile Dyeing Operations", 2-3, 84-105 (1986).

"Dyes, Reactive" in Kirk-Othmer, Encyclopedia of Chemical Technology, 3rd edition, 8:374-385 (1979).

*Primary Examiner*—Patrick P. Garvin
*Assistant Examiner*—E. D. Irzinski
*Attorney, Agent, or Firm*—Howson and Howson

[57] ABSTRACT

A process is disclosed for providing a solvent-spun cellulose fiber with a reduced fibrillation tendency. The fiber is treated with a chemical reagent, preferably substantially colorless, having 2 to 6 functional groups reactive with cellulose, suitably dissolved in an aqueous solution.

33 Claims, No Drawings

PROCESS FOR REDUCING THE FIBRILLATION TENDENCY OF SOLVENT-SPUN CELLULOSE FIBRE

BACKGROUND OF THE INVENTION

I. Field of the Invention

This invention is concerned with the treatment of fibres and has particular relevance to the treatment of fibres to reduce their tendency to fibrillation and to the treatment of solvent-spun cellulose fibres.

Proposals have been made to produce cellulose fibres by spinning a solution of cellulose in a suitable solvent. An example of such a process is described in GB-A-2043525, the contents of which are incorporated herein by way of reference. In such a solvent-spinning process, cellulose is dissolved in a solvent for the cellulose such as a tertiary amine N-oxide, for example N-methylmorpholine N-oxide. The resulting solution is then extruded through a suitable die to produce a series of filaments, which are washed in water to remove the solvent and subsequently dried. Such cellulose fibres are referred to herein as "solvent-spun" cellulose fibres and are to be contrasted with fibres produced by chemical regeneration of cellulose compounds, such as viscose fibres, cuprammonium fibres, polynosic fibres and the like.

The present invention is particularly concerned with the treatment of such solvent-spun cellulose fibres so as to reduce the tendency of the fibres to fibrillate. Fibrillation is the breaking up in a longitudinal mode of a fibre to form a hairy structure. A practical process to reduce fibrillation tendency needs not only to inhibit fibrillation but also to have a minimal effect on subsequent processability of the fibre and to have as little as possible effect on tenacity and extensibility of the fibre. Some processes which have been investigated by the applicants and which will reduce the fibrillation tendency have the unwanted side effects either of reducing the tenacity and the extensibility of the fibre or of embrittling the fibre so as to make it unprocessable.

Cellulose fabrics have been treated with resins to give improved crease resistance. This type of treatment is described in an article entitled "Textile Resins" in Encyclopaedia of Polymer Science and Technology, Volume 16 (1989, Wiley-Interscience) at pages 682–710. The resins used are generally polyfunctional materials which react with and crosslink cellulose. Resin treatment may reduce breaking strength and tearing strength as well as abrasion resistance. Fabrics are usually dyed before crosslinking because the dye cannot penetrate the crosslinked fibre.

The literature on the dyeing of fibres, including natural cellulosic fibres such as cotton and artificial cellulosic fibres such as cuprammonium and viscose rayon, is extensive. Representative examples of this literature include: Man-Made Fibres, R. W. Moncrieff, 6th Edition (Newnes-Butterworth, 1975), Chapter 49 (pages 804–951); an article entitled "Dyeing" in Encyclopaedia of Polymer Science and Engineering, Volume 5 (Wiley-Interscience, 1986), pages 214–277; and Textile Dyeing Operations, S. V. Kulkami et al. (Noyes Publications, 1986). Common types of dye for cellulose include direct dyes, azo dyes, fibre-reactive dyes, sulphur dyes and vat dyes. The choice of dye for any particular application is governed by various factors including but not limited to the desired colour, levelness of dyeing, effect on lustre, wash-fastness, light-fastness and cost.

Reactive dyes are described in an article entitled "Dyes, Reactive" in Kirk-Othmer, Encyclopaedia of Chemical Technology, 3rd edition, Volume 8 (1979, Wiley-Interscience) at pages 374–392. These dyes contain a chromophore system attached directly or indirectly to a unit which carries one or more functional groups reactive with the material to be dyed. Reactive dyes for cellulosic materials are particularly described at pages 380–384 of the above-mentioned article. The reactive functional groups tend to hydrolyse in the dye bath, and reactive dyes containing several reactive groups have been used to provide higher fixation efficiency.

2. Description of Related Art

GB-A-878655 describes a process in which a synthetic resin is incorporated in a regenerated cellulose fibre. Never-dried conventional viscose rayon fibre has a water imbibition of 120–150% and is squeezed to reduce the water imbibition to 100%. (Water imbibition is defined as the weight of water retained per unit weight of bone-dry fibre.) The squeezed fibre is then treated with a crosslinking agent, for example a formaldehyde resin precondensate, squeezed again to reduce the water imbibition to 100%, dried, and heated to cure the resin. The cured resin crosslinks the fibre, and the treated fibre has improved processability into yarn and cloth. GB-A-950073 describes a similar process. Such processes do, however, embrittle the fibre and reduce extensibility.

FR-A-2273091 describes a method of manufacturing polynosic viscose rayon fibre with reduced fibrillation tendency. The fibre is treated in the primary gel state characteristic of polynosic viscose rayon manufacture with a crosslinking agent containing at least two acrylamido groups and an alkaline catalyst. This primary polynosic gel is a highly swollen gel having a water imbibition of 190–200%, which is only found in polynosic viscose rayon that has never been dried.

EP-A-118983 describes a method of treating natural textile fibres, for example wool and cotton, and synthetic polyamide fibres to enhance their affinity for disperse or anionic dyestuffs. The fibres are treated with an aqueous solution or dispersion of an arylating agent. The arylating agent contains both a hydrophobic benzene or naphthalene ring and a reactive group such as a halotriazine group.

EP-A-174794 describes a method of treating natural textile fibres, for example wool and cotton, and synthetic polyamide fibres with an arylating agent. This treatment provides cellulose fibres and fabrics with improved dye affinity and crease recovery. The arylating agent preferably contains at least one functional group which is a vinyl sulphone or a precursor thereof.

SUMMARY OF THE INVENTION

The present invention addresses the need for a process which not only reduces the fibrillation tendency of solvent-spun cellulose fibres, but also produces no significant reduction in tenacity and extensibility and has no significant deleterious effect on processability. Maintaining a balance between all of the required properties of the solvent-spun fibre is extremely difficult because it is not sufficient to produce a fibre which will not fibrillate but which has a very low tenacity or a very low extensibility or a very poor processability. In some cases it would also be unsatisfactory to produce a fibre which would be unsuitable for subsequent dyeing.

A process according to the present invention for providing a solvent-spun cellulose fibre with a reduced fibrillation tendency is characterised in that the fibre is treated with a chemical reagent having two to six functional groups reactive with cellulose. Preferably, the untreated and treated fibre are of substantially the same colour, that is to say the treatment does not substantially affect the colour of the fibre, and this is hereinafter referred to as the preferred form of the invention.

DETAILED DESCRIPTION OF THE INVENTION

Fibrillation of cellulose fibres as herein described is believed to be due to mechanical abrasion of the fibres whilst being processed in a wet and swollen form. Solvent-spun fibres appear to be particularly sensitive to such abrasion and are consequently more susceptible to fibrillation than other types of cellulose fibres. Higher temperatures and longer times of wet processing tend to lead to greater degrees of fibrillation. Wet treatment processes such as dyeing processes inevitably subject fibres to mechanical abrasion. Reactive dyes generally demand the use of more severe dyeing conditions than other types of dyes, for example direct dyes, and therefore subject the fibres to correspondingly more severe mechanical abrasion. It was therefore both remarkable and unexpected to find that the selection as chemical reagent in accordance with the invention of polyfunctional reactive-dyes from the class of dyes suitable for dyeing cellulose should produce a lower degree of fibrillation than for example monofunctional reactive dyes or direct dyes.

The chemical reagents utilised in the preferred form of the present invention differ from reactive dyes in that they do not contain a chromophore and so are substantially colourless. Treatment with such reagents therefore does not substantially alter the colour of the solvent-spun cellulose fibre. Accordingly, the treated fibre is suitable for dyeing in any manner known for cellulose fibres, yarns or fabrics.

The functional groups reactive with cellulose may be any of those known in the art. Numerous examples of such groups are given in the above-mentioned article entitled "Dyes, Reactive". Preferred examples of such functional groups are reactive halogen atoms attached to a polyazine ring, for example fluorine, chlorine or bromine atoms attached to a pyridazine, pyrimidine or sym-triazine ring. Other examples of such functional groups include vinyl sulphones and precursors thereof. Each functional group in the reagent may be the same or different.

The chemical reagent preferably contains at least one ring with at least two, in particular two or three, reactive functional groups attached thereto. Examples of such rings are the polyhalogenated polyazine rings hereinbefore mentioned. Such reagents have been found to be more effective at reducing the fibrillation tendency than reagents in which the functional groups are more widely separated, for example reagents in which two monohalogenated rings are linked together by an aliphatic chain. One preferred type of reagent contains one ring having two reactive functional groups attached thereto. Other types of reagent, which may also be preferred, contain two or three rings linked by aliphatic groups and having two reactive functional groups attached to each ring. Preferred types of reagent include reagents containing a dichlorotriazinyl, trichloropyrimidinyl, chlorodifluoropyrimidinyl, dichloropyrimidinyl, dichloropyridazinyl, dichloropyridazinonyl, dichloroquinoxalinyl or dichlorophthalazinyl group. Other preferred types of dye include dyes having at least two vinyl sulphone, beta-sulphatoethyl sulphone or betachloroethyl sulphone groups attached to a polyazine ring.

The chemical reagent is preferably applied to the fibre in an aqueous system, more preferably in the form of an aqueous solution. The chemical reagent may contain one or more solubilising groups to enhance its solubility in water. A solubilising group may be an ionic species, for example a sulphonic acid group, or a non-ionic species, for example an oligomeric poly(ethylene glycol) or poly(propylene glycol) chain. Nonionic species generally have less effect on the essential dyeing characteristics of the cellulose fibre than ionic species and may be preferred for this reason, in particular in the preferred form of the invention. The solubilising group may be attached to the chemical reagent by a labile bond, for example a bond which is susceptible to hydrolysis after the chemical reagent has reacted with the cellulose fibre.

The known processes for the manufacture of solvent-spun cellulose fibres include the steps of:

(i) dissolving cellulose in a solvent to form a solution, the solvent being miscible with water;

(ii) extruding the solution through a die to form a fibre precursor;

(iii) passing the fibre precursor through at least one water bath to remove the solvent and form the fibre; and (iv) drying the fibre.

The wet fibre at the end of step (iii) is never-dried fibre, and typically has a water imbibition in the range 120–150%. The dried fibre after step (iv) typically has a water imbibition of around 60–80%. In one embodiment of the invention, the fibre is treated with the chemical reagent in its never-dried state, that is to say, during or after step (iii) but before step (iv). The fibre may be in the form of staple fibre or tow, depending on the configuration of the equipment. An aqueous solution of the chemical reagent may for example be applied to the never-dried fibre by means of a circulating bath, spray or bubbler. This embodiment may be preferred when the reagent is a substantially colourless reagent, that is to say in the preferred form of the invention.

Alternatively, in another embodiment of the invention the method of treatment of the invention may be carried out using conventional techniques for reactive dyestuffs, in which the chemical reagent is used in the same or similar manner as a reactive dyestuff. In this embodiment, the method may be carried out on tow or staple fibre, yarn or fabric. The method of treatment in the preferred form of the invention may be carried out on dried fibre after or more preferably before or simultaneously with dyeing. If the treatment is performed before or after dyeing, the fibre is preferably not dried between the treatment and dyeing processes. The method of treatment may be carried out using a dye bath which contains both a monofunctional reactive dyestuff and the chemical reagent, which may be a dyestuff or a substantially colourless reagent. The method of treatment may be carried out using a bath containing more than one type of chemical reagent, for example one or more dyestuffs and one or more substantially colourless reagents. The functional groups in any such dyestuffs and reagents may be the same or different chemical species.

The functional groups reactive with cellulose in reactive dyes as well as in the chemical reagents used in the present invention may react most rapidly with cellulose under alkaline conditions and reagents containing such groups may be preferred. Examples of such functional groups are the halogenated polyazine rings hereinbefore mentioned. Such chemical reagents may therefore be applied from weakly alkaline solution, for example from a solution made alkaline by the addition of sodium carbonate (soda ash) , sodium bicarbonate or sodium hydroxide. Alternatively, the fibre may be made alkaline by treatment with mild aqueous alkali in a first stage before treatment in a second stage with the solution of the chemical reagent. The first stage of this two-stage technique is known in the dyeing trade as presharpening. It has the advantage that hydrolysis of the functional groups in the solution of the reagent is reduced, since hydrolysis of such groups is more rapid under alkaline conditions. The solution of the chemical reagent used in the second stage of the two-stage technique may or may not contain added alkali. If the two-stage technique is used then preferably substantially all the alkali is applied in the first stage. Fibre treated in this manner has generally and surprisingly been found to have a lower fibrillation tendency than in the case when alkali is applied in both of the stages. It has surprisingly also been found that the fibrillation tendency of the treated fibre may be less after a two-stage treatment in which substantially all the alkali is added in the first stage than after a single stage treatment, although the reason for this is not known. This two-stage technique is accordingly a preferred method of putting the invention into practice.

The functional groups of the chemical reagent may react with cellulose at room temperature, but it is generally preferable to apply heat to induce a substantial degree of reaction. For example, the reagent may be applied using a hot solution, or the fibre wetted with the reagent may be heated or steamed, or the wetted fibre may be heated to dry it. Preferably, the wetted fibre is steamed because this method of heating has generally been found to yield fibre with the lowest fibrillation tendency. Low-pressure steam is preferably used, for example at a temperature of 100° to 110° C., and the steaming time is typically 4 seconds to 20 minutes, more narrowly 5 to 60 seconds or 10 to 30 seconds.

In chemical reagents carrying more than one of a particular type of functional group, it is often found that the functional groups have different reactivities. This is true for example for the polyhalogenated polyazines hereinbefore mentioned. The first halogen atom reacts more rapidly with cellulose than a second or subsequent halogen atom. The method of the invention may be carried out under conditions such that only one such functional group reacts during the treatment stage, and the remaining functional group or groups is or are caused to react subsequently, for example by the application of heat during steaming or drying or by the application of alkali during subsequent fabric wet processing.

The fibre may be rinsed with a mildly acidic aqueous solution, for example a weak solution of acetic acid, after reaction of the chemical reagent with the cellulose in order to neutralise any added alkali.

The fibre may be treated with 0.1 to 10%, preferably 0.2 to 5%, further preferably 0.2 to 2%, by weight of the chemical reagent, although some of the reagent may be hydrolysed and so not react with the fibre. In the preferred form of the invention the chemical reagent may be reacted with the cellulose fibre so that less than 20%, and preferably less than 10% and further preferably 5% or less, of the dye sites on the cellulose fibre are occupied, so as to permit subsequent colouration of the fibre with coloured dyes which may or may not be reactive dyes.

Cellulose fibres, particularly in the form of fabrics made from such fibres, may be treated with a cellulase enzyme to remove surface fibrils. The cellulase enzyme may be in the form of an aqueous solution, and the concentration may be in the range 0.5% to 5%, preferably 0.5% to 3%, by weight. The pH of the solution may be in the range 4 to 6. There may be a nonionic detergent in the solution. The fabric may be treated at a temperature in the range 20° C. to 70° C., preferably 40° C. to 65° C., further preferably 50° C. to 60° C., for a period in the range 15 minutes to 4 hours. This cellulase treatment may be utilised to remove fibrils from solvent-spun fibres, yarns and fabrics which have been treated with a chemical reagent according to the method of the invention.

Solvent-spun cellulose fibre is commercially available from Courtaulds Fibres Limited.

The invention is illustrated by the following Examples.

Fibre was assessed for degree of fibrillation using the method described below as Test Method 1 and assessed for fibrillation tendency using the techniques described below as Test Methods 2–4.

Test Method 1 (Assessment of Fibrillation)

There is no universally accepted standard for assessment of fibrillation, and the following method was used to assess Fibrillation Index. A series of samples of fibre having nil and increasing amounts of fibrillation was identified. A standard length of fibre from each sample was then measured and the number of fibrils (fine hairy spurs extending from the main body of the fibre) along the standard length was counted. The length of each fibril was measured, and an arbitrary number, being the product of the number of fibrils multiplied by the average length of each fibril, was determined for each fibre.

The fibre exhibiting the highest value of this product was identified as being the most fibrillated fibre and was assigned an arbitrary Fibrillation Index of 10. The wholly unfibrillated fibre was assigned a Fibrillation Index of zero, and the remaining fibres were evenly ranged from 0 to 10 based on the microscopically measured arbitrary numbers.

The measured fibres were then used to form a standard graded scale. To determine the Fibrillation Index for any other sample of fibre, five or ten fibres were visually compared under the microscope with the standard graded fibres. The visually determined numbers for each fibre were then averaged to give a Fibrillation Index for the sample under test. It will be appreciated that visual determination and averaging is many times quicker than measurement, and it has been found that skilled fibre technologists are consistent in their rating of fibres.

Test Method 2 (Scour, Bleach, Dye)

(i) Scour 1 g fibre was placed in a stainless steel cylinder approximately 25 cm long by 4 cm diameter and having a capacity of approximately 250 ml. 50 ml of a conventional scouring solution containing 2 g/l Detergyl (an anionic detergent) (Detergyl is a Trade Mark of ICI plc) and 2 g/l sodium carbonate was added, a screw cap fitted, and the capped cylinder tumbled end-over-end at 60 tumbles per minute for 60 minutes at 95° C. The scoured fibre was then rinsed with hot and cold water.

(ii) Bleach 50 ml of a bleaching solution containing 15 ml/l 35% hydrogen peroxide, 1 g/l sodium hydroxide, 2 g/l Prestogen PC as a peroxide stabiliser (Prestogen is a Trade Mark of BASF AG) and 0.5 ml/l Irgalon PA as a sequestrant (Irgalon is a Trade Mark of Ciba Geigy AG) was added to the fibre and a screw cap fitted to the cylinder. The cylinder was then tumbled as before for 90 minutes at 95° C. The bleached fibre was then rinsed with hot and cold water.

(iii) Dye 50 ml of a dyeing solution containing 8%, on weight of fibre, Procion Navy HER 150 (Procion is a Trade Mark of ICI plc) and 55 g/l Glauber's salt was added, the cylinder capped, and tumbled as before for 10 minutes at 40° C. The temperature was raised to 80° C. and sufficient sodium carbonate added to give a concentration of 20 g/l. The cylinder was then capped once more and tumbled for 60 minutes. The fibre was rinsed with water. 50 ml of a solution containing 2 ml/l Sandopur SR (an anionic detergent) (Sandopur is a Trade Mark of Sandoz Ltd) was then added and the cylinder capped. The cylinder was then tumbled as before for 20 minutes at 100° C. The dyed fibre was then rinsed and dried. It was then assessed for fibrillation using Test Method 1.

Test Method 3 (Ball Bearing)

1 g fibre was placed in a 200 ml metal dye pot together with 100 ml of a solution containing 0.8 g/l Procion Navy HER 150 (Procion is a Trade Mark of ICI plc), 55 g/l Glauber's salt and a 2.5 cm diameter ball bearing. The purpose of the ball bearing was to increase the abrasion imparted to the fibre. The pot was then capped and tumbled end-over-end at 60 tumbles per minute for 10 minutes at 40° C. The temperature was raised to 80° C. and sufficient sodium carbonate added to give a concentration of 20 g/l. The pot was then capped once more and tumbled for 3 hours. The ball bearing was then removed and the fibre rinsed with water. 50 ml of a solution containing 2 ml/l Sandopur SR (an anionic detergent) (Sandopur is a Trade Mark of Sandoz Ltd) was then added and the cylinder capped. The cylinder was then tumbled as before for 20 minutes at 100° C. The dyed fibre was then rinsed and dried. It was then assessed for fibrillation using Test Method 1. Test Method 3 provides more severe fibrillating conditions than Test Method 2.

Test Method 4 (Blender)

0.5 g fibre cut into 5–6 mm lengths and dispersed in 500 ml water at ambient temperature was placed in a household blender (liquidiser) and the blender run for 2 minutes at about 12000 rpm. The fibre was then collected, dried and assessed for fibrillation using Test Method 1. Test Method 4 provides more severe fibrillating conditions than either Test Method 2 or Test Method 3.

The following Examples illustrate the preferred form of the invention.

EXAMPLE 1

Cyanuric chloride was reacted with an equimolar quantity of poly(ethylene glycol) monomethyl ether having molecular weight 550 to prepare a colourless chemical reagent having two functional groups reactive with cellulose. A solution was made up containing 50 g/l of this reagent and 20 g/l sodium carbonate. A hank of never-dried solvent-spun cellulose fibre having a water imbibition of about 120–150% was immersed in this solution, removed and squeezed to remove excess treatment liquor. The hank was then placed in a steamer at 102° C. for 5 minutes, rinsed with water and dried. It exhibited a Fibrillation Index of 1.2. Untreated never-dried fibre subjected to the same steaming procedure exhibited a Fibrillation Index of 3.4.

The reagent loading was 3% by weight on fibre; the reagent exhibited a reaction efficiency of 30% (i.e., 70% of the reagent did not react with the cellulose), so that the weight of reagent on the wetted hank was 1% by weight on cellulose. About half this reagent reacted with the cellulose, so that the treated fibre contained about 0.5% by weight of reacted reagent.

EXAMPLE 2

Sandospace R (Sandospace is a Trade Mark) is a colourless chlorotriazine compound available from Sandoz AG in the form of a paste and used to provide dye-resist effects on natural and synthetic polyamide fibres. A solution was made up containing 50 g/l Sandospace R paste, 20 g/l sodium bicarbonate and 100 g/l Glauber's salt at 70° C. A hank of never-dried solvent-spun cellulose fibre having a water imbibition of about 120–150% and weighing about 50 g was immersed in 500 g of this solution for 8 minutes. It was then removed from the solution, squeezed to remove excess treatment liquor, rinsed with water, neutralised by washing with 1 g/l aqueous acetic acid and dried.

The treated fibre exhibited a Fibrillation Index of 0.3 measured by Test Method 3 and 3.8 measured by Test Method 4.

EXAMPLE 3

A solution was made up containing 50 g/l Sandospace R paste, 20 g/l sodium carbonate, 25 g/l Glauber's salt and 10 g/l Matexil PAL (a mild oxidising agent-nitrobenzene sulphonic acid-used as a textile auxiliary to prevent dye reduction) (Matexil is a Trade Mark of ICI plc). A hank of dried solvent-spun cellulose fibre weighing 50 g was immersed in the solution, removed and squeezed to remove excess treatment liquor. The wetted hank weighed 90 g, corresponding to a liquor uptake of 80%. The wetted hank was placed in a steamer at 102° C. for 8 minutes, after which it was neutralised by washing with cold 0.1% by volume aqueous acetic acid and dried.

The treated fibre was subjected to the domestic wash treatment described in Example 2. It exhibited a Fibrillation Index of 0.6 as measured by Test Method 2.

EXAMPLE 4

Never-dried solvent-spun cellulose fibre was treated with solutions containing 50 g/l Sandospace R under various conditions and assessed for fibrillation tendency by Test Methods 2–4. After padding with the reagent solution, the wetted fibre was either heated at 70° C. or steamed at 102° C., rinsed with 0.1% by volume aqueous acetic acid and dried. Experimental conditions and results are shown in Table 1:

TABLE 1

| Ref. | $Na_2CO_3$ g/l | Reagent Bath $NaHCO_3$ g/l | Reagent Bath $Na_2SO_4$ g/l | Time min. | Temp °C. | Fibrillation Index Scour-bleach-dye | Fibrillation Index Ball bearing | Blender |
|---|---|---|---|---|---|---|---|---|
| Control | — | — | — | — | — | 1.2 | 1.0 | 4.65 |
| 4A | 20 | — | — | 15 | 70 | 1.0 | 0.0 | 3.2 |
| 4B | 10 | — | 100 | 6 | 70 | 1.2 | 1.4 | 3.0 |
| 4C | — | 20 | 100 | 8 | 70 | 0.0 | 0.3 | 3.5 |
| 4D | 20 | — | 100 | 5 | 102 | 0.0 | 1.1 | 3.3 |
| 4E | 20 | — | 100 | 10 | 102 | 0.2 | 0.45 | 2.7 |
| 4F | 20 | — | 100 | 20 | 102 | 0.2 | 1.2 | 1.1 |
| 4G | 10 | — | 75 | 5 | 70 | 0.2 | 0.9 | 2.4 |

The treatment of Example 4G was carried out three times before rinsing, drying and assessing fibrillation tendency.

EXAMPLE 5

Never-dried solvent-spun cellulose fibre was padded with solutions containing various amounts of Sandospace R, 20 g/l sodium carbonate and 100 g/l sodium sulphate, steamed at 102° C., rinsed with 0.1% by volume aqueous acetic acid and dried. The treated fibre was assessed for fibrillation tendency by Test Method 4. Experimental conditions and results are shown in Table 2:

TABLE 2

| Ref. | Sandospace R g/l | Steam min | Fibrillation Index (Blender) |
|---|---|---|---|
| Control | — | — | 5.3 |
| 5A | 50 | 20 | 3.1 |
| 5B | 80 | 20 | 3.0 |
| 5C | 100 | 20 | 3.0 |
| 5D | 100 | 5 | 3.0 |
| 5E | 100 | 10 | 1.85 |

Previously-dried solvent-spun cellulose fibre was padded with solutions containing Sandospace R and other components, steamed at 102° C., rinsed with 0.1% by volume aqueous acetic acid and dried. The treated fibre was assessed for fibrillation tendency by Test Methods 2–4. Experimental conditions and results are shown in Table 3, in which Matexil is Matexil PAL:

TABLE 3

| Ref. | Sandospace R g/l | Other Components | Fibrillation Index Scour-bleach-dye | Fibrillation Index Ball bearing | Blender |
|---|---|---|---|---|---|
| 6A | 50 | $Na_2CO_3$ 20 g/l; Matexil 10 g/l | 0.0 | 0.94 | 3.0 |
| 6B | 50 | $Na_2CO_3$ 20 g/l | 0.0 | 2.6 | 3.2 |
| 6C | 50 | $Na_3PO_4$ 10 g/l; Matexil 10 g/l | 0.0 | 1.38 | 2.4 |
| 6D | 50 | $Na_3PO_4$ 10 g/l | 0.7 | 1.8 | 2.3 |
| 6E | 50 | $NaHCO_3$ 5 g/l; Matexil 10 g/l | 0.1 | 0.6 | 2.2 |
| 6F | 50 | $NaHCO_3$ 5 g/l | 0.0 | 0.6 | 3.8 |
| 6G | 50 | $Na_2CO_3$ 20 g/l; $Na_2SO_4$ 25 g/l; Matexil 10 g/l | 0.6 | 0.1 | 2.1 |
| 6H | 50 | $Na_2CO_3$ 20 g/l; $Na_2SO_4$ 25 g/l | 0.2 | 1.2 | 0.6 |
| 6I | 80 | $Na_2CO_3$ 20 g/l; Matexil 10 g/l | 0.0 | 1.34 | 3.2 |
| 6J | 80 | $Na_3PO_4$ 10 g/l; Matexil 10 g/l | 0.0 | 0.6 | 3.9 |
| 6K | 80 | $Na_2CO_3$ 5 g/l; Matexil 10 g/l | 0.0 | 0.2 | 3.3 |
| 6L | 80 | $Na_2CO_3$ 20 g/l; $Na_2SO_4$ 25 g/l | 0.3 | 2.8 | 2.8 |

EXAMPLE 7

Solvent-spun cellulose never-dried fibre was padded with solutions containing various amounts of Sandospace R, soda ash and Glauber's salt, steamed at 102° C. for various times, rinsed with 0.1% by volume aqueous acetic acid and dried. The treated fibre was assessed for fibrillation tendency by Test Method 4. Experimental conditions and results are shown in Table 4:

TABLE 4

| Ref. | Sandospace R g/l | $Na_2CO_3$ g/l | $Na_2SO_4$ g/l | Steam min | Fibrillation Index (Blender) |
|---|---|---|---|---|---|
| Control | — | — | — | — | 5.1 |
| 7A | 20 | 0 | 0 | 0 | 2.6 |
| 7B | 20 | 10 | 50 | 5 | 2.1 |
| 7C | 20 | 20 | 100 | 10 | 0.8 |
| 7D | 50 | 0 | 100 | 5 | 3.2 |
| 7E | 50 | 10 | 0 | 10 | 2.4 |
| 7F | 50 | 20 | 50 | 0 | 3.3 |
| 7G | 100 | 0 | 50 | 10 | 3.2 |
| 7H | 100 | 10 | 100 | 0 | 2.0 |
| 7I | 100 | 20 | 0 | 5 | 0.9 |

EXAMPLE 8

Poly(ethylene glycol) monomethyl ether (molecular weight 2000) (100 g, 0.05 mol) was dissolved in tetrahydrofuran (400 ml). Cyanuric chloride (0.05 mol) and tertiary amine (0.05 mol) (pyridine or triethylamine) were added to the solution which was maintained at 30° C. for 2 hours. Amine hydrochloride was removed by filtration and solvent removed by evaporation to yield a chemical reagent which was denoted SCIII. This is believed to have the chemical constitution:

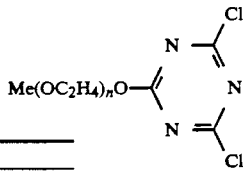

(where n corresponds to the degree of polymerisation of the poly(ethylene glycol) monomethyl ether starting material), and therefore to have two functional groups reactive with cellulose. The reagent was soluble in water due to the presence of the poly(ethylene glycol) chain. Never-dried solvent-spun cellulose fibre was padded with solutions containing various amounts of SCIII and other compounds, heated at 70° C. or steamed at 102° C., rinsed with 0.1% by volume aqueous acetic acid and dried. The treated fibre was assessed for fibrillation tendency by Test Methods 2–4. Experimental conditions and results are shown in Table 5, in which Matexil is Matexil PAL:

TABLE 5

| | Reagent Bath | | | | | | Fibrillation Index | | |
|---|---|---|---|---|---|---|---|---|---|
| Ref. | SCIII g/l | $Na_2CO_3$ g/l | $Na_2SO_4$ g/l | Other Components | Time min | Temp °C. | Scour-bleach-dye | Ball bearing | Blender |
| Control | — | — | — | | | | 1.1 | 3.2 | 4.6 |
| 8A | 20 | 10 | 100 | — | 6 | 70 | 0.0 | 3.1 | 3.5 |
| 8B | 40 | 10 | 100 | — | 6 | 70 | 0.0 | 2.2 | 3.2 |
| 8C | 80 | 10 | 100 | — | 6 | 70 | 0.8 | 1.2 | 3.2 |
| 8D | 40 | 10 | 100 | — | 5 | 102 | 0.4 | 2.8 | 2.8 |
| 8E | 40 | 10 | 100 | — | 10 | 102 | 1.7 | 2.7 | 3.4 |
| 8F | 40 | 10 | 100 | — | 18 | 102 | 0.4 | 0.4 | 2.9 |
| 8G | 40 | 20 | 100 | Matexil 10 g/l | 10 | 102 | 0.5 | 2.5 | 4.5 |
| 8H | 40 | — | — | $Na_3PO_4$ 10 g/l; Matexil 10 g/l | 10 | 102 | 1.7 | 0.6 | 3.0 |

Padding was performed three times before steaming on Examples 8D–8G.

EXAMPLE 9

The procedure of Example 8 was repeated, except that fibrillation tendency was assessed using only Test Method 4. Experimental conditions and results are shown in Table 6:

TABLE 6

| Ref. | SCIII g/l | $Na_2CO_3$ g/l | $Na_2SO_4$ g/l | Time min | Temp °C. | Fibrillation Index (Blender) |
|---|---|---|---|---|---|---|
| Control | — | — | — | — | — | 5.6 |
| 9A | 40 | 20 | 100 | 5 | 102 | 3.3 |
| 9B | 40 | 20 | 100 | 10 | 102 | 2.9 |
| 9C | 40 | 20 | 100 | 20 | 102 | 3.5 |
| 9D | 40 | 10 | 100 | 5 | 102 | 2.5 |
| 9E | 40 | 10 | 100 | 10 | 102 | 2.3 |
| 9F | 40 | 10 | 100 | 20 | 102 | 4.1 |
| 9G | 40 | 20 | 100 | 20 | 102 | 4.3 |

In Example 9G, the fibre was padded with an aqueous solution containing 20 g/l soda ash before padding with the treatment liquor described in the Table.

EXAMPLE 10 AND COMPARATIVE EXAMPLES A–C

The procedure of Example 9 was repeated, under the conditions and with the results shown in Table 7:

TABLE 7

| Ref. | SCIII g/l | $NaHCO_3$ g/l | $Na_2SO_4$ g/l | Matexil PAL g/l | Time min | Temp °C. | Fibrillation Index |
|---|---|---|---|---|---|---|---|
| 10A | 100 | 20 | 100 | 10 | 10 | 102 | 0.7 |
| 10B | 100 | 20 | 100 | 10 | — | — | 1.6 |
| A | — | 20 | 100 | 10 | 10 | 102 | 4.7 |
| B | — | 20 | — | 10 | 10 | 102 | 4.8 |
| C | — | — | — | — | 10 | 102 | 4.1 |
| Control | — | — | — | — | — | — | 4.9 |

The results of Comparative Examples A–C show that the greatest improvement in fibrillation tendency is to be attributed to the use of the chemical reagent SCIII rather than to any other part of the treatment.

EXAMPLE 11

Cyanuric chloride was reacted with various substances to give chemical reagents having four functional groups reactive with cellulose. The reference codes of the chemical reagents and the names of the substances reacted with cyanuric chloride are listed below:

| | |
|---|---|
| SCV | Jeffamine ED2001 (Texaco Inc.) - $H_2N(C_2H_5O)_nNH_2$ |
| SCVI | Poly(ethylene glycol), mol. wt. 5000 |
| SCVII | Poly(ethylene glycol), mol. wt. 2000 |

The reactions were carried out according to the general procedure of Example 8, except that 2 moles of cyanuric chloride and 2 moles of tertiary amine were reacted with each mole of substance. The preparation of SCV was carried out at 0° C. These reagents are believed to have the chemical constitution:

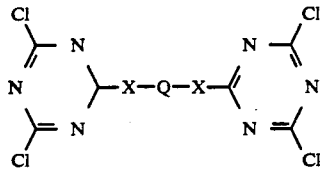

where x represents NH or O and Q represents $(C_2H_4O)_nC_2H_4$, n being an integer representative of the degree of polymerisation of the starting substance. These reagents each therefore contained two sym-triazine rings connected by an aliphatic chain, each of the rings carrying two functional groups reactive with cellulose. Each reagent contained a poly(ethylene glycol) chain and was soluble in water.

Never-dried solvent-spun cellulose tow was padded with alkaline aqueous solutions of these reagents containing 100 g/l sodium sulphate and 10 g/l Matexil PAL, steamed for 10 minutes, rinsed with 0.1% aqueous acetic acid and dried. Fibrillation tendency was assessed by Test Method 4 (blender). Experimental conditions and results are shown in Table 8; a control sample exhibited a Fibrillation Index of 4.0:

TABLE 8

| Reagent | NaOH | $Na_2CO_3$ | $NaHCO_3$ | Fibrillation Index | | |
|---|---|---|---|---|---|---|
| g/l | g/l | g/l | g/l | SCV | SCVI | SCVII |
| 100 | — | 10 | — | 2.7 | 2.4 | 4.9 |
| 150 | — | 10 | — | 3.2 | 2.9 | 3.3 |
| 100 | — | 20 | — | 3.7 | 2.9 | 3.3 |
| 150 | — | 20 | — | 2.4 | 3.8 | 3.7 |
| 100 | — | — | 20 | 0.65 | 1.0 | 1.7 |
| 150 | — | — | 20 | 2.8 | 3.4 | 3.7 |
| 100 | 10 | — | — | 2.5 | 3.9 | 3.9 |
| 150 | 10 | — | — | 3.2 | 4.7 | 3.3 |

EXAMPLE 12

Never-dried solvent-spun cellulose tow was treated with an aqueous solution containing 100 g/l reagent SCV, 20 g/l sodium bicarbonate, 100 g/l sodium sulphate and 10 g/l Matexil PAL, steamed for 10 minutes, rinsed with 0.1% aqueous acetic acid and dried. Fibrillation tendency was assessed by Test Method 4 (blender). This procedure was repeated with variations, as shown in Table 9:

TABLE 9

| Variation | Fibrillation Index |
|---|---|
| Control | 4.9 |
| No steam | 0.2 |
| Steam 1 min | 0.2 |
| Steam 5 min | 0.1 |
| Steam 10 min | 0.4, 0.5 |
| Warm tow, pad at 50° C., steam 1 min | 0.1 |
| 50 g/l SCV | 3.3 |
| 200 g/l SCV | 0.1 |
| 5 g/l NaHCO3 | 2.1 |
| 10 g/l NAHCO3 | 2.4 |
| 160 g/l SCV, 10 g/l $Na_2CO_3$, steam 20 min | 1.9 |
| 160 g/l SCV, 10 g/l $Na_2CO_3$, dry, steam 1 min | 3.6 |

EXAMPLE 1.3

Never-dried solvent-spun cellulose tow was treated with an aqueous solution containing 100) g/l reagent SCV, 20 g/l sodium bicarbonate, 100 g/l sodium sulphate and 10 g/l Matexil PAL, steamed or heated under various conditions, rinsed with 0.1% aqueous acetic acid and dried. Fibrillation tendency was assessed by Test Method 4 (blender). Experimental conditions and results are shown in Table 10:

TABLE 10

| Steaming Conditions | | | |
|---|---|---|---|
| Temperature °C. | Humidity % | Time min | Fibrillation Index |
| Control | | | 5.5 |
| — | — | — | 2.7 |
| 100 | Dry Heat | 10 | 3.7 |
| 100 | Dry Heat | 20 | 2.0 |
| 120 | 20 | 10 | 0.3 |
| 120 | 30 | 10 | 0.4 |
| 120 | 40 | 10 | 0.1 |
| 100 | 98 | 10 | 0.2 |
| 110 | 98 | 10 | 0.1 |
| 120 | 98 | 10 | 0.3 |
| 140 | 98 | 10 | 0.2 |

EXAMPLE 14

Example 13 was repeated, except that only 50 g/l reagent SCV was used. Experimental conditions and results are shown in Table 11

TABLE 11

| Steaming Conditions | | | |
|---|---|---|---|
| Temperature °C. | Humidity % | Time min | Fibrillation Index |
| Control | | | 4.8 |
| 100 | 98 | 5 | 3.3 |
| 120 | 40 | 5 | 0.3 |
| 120 | 98 | 5 | 3.4 |
| 140 | 98 | 5 | 2.5 |

EXAMPLE 15

Cyanuric chloride was reacted with an equimolar quantity of N-methyltaurine to give a chemical reagent containing two functional groups reactive with cellulose and an ionic solubilising group, namely 2-dichlorotriazinylamino-2-methylethanesulphonic acid.

Never-dried solvent-spun cellulose tow was treated with an aqueous solution containing 50 g/l of this reagent, 20 g/l sodium bicarbonate and 10 g/l Matexil PAL, steamed for 10 minutes, rinsed with 0.1% aqueous acetic acid and dried. The fibrillation tendency was assessed by Test Method 4 (blender) and a Fibrilllation Index of 0.2 was found.

Never-dried solvent-spun cellulose tow was treated with an aqueous solution containing 40 g/l of this reagent, 10 g/l sodium bicarbonate and 100 g/l sodium sulphate, steamed for 20 minutes, rinsed with 0.1% aqueous acetic acid and dried. Fibrillation Index was 1.3.

A control sample exhibited a Fibrillation Index of 4.85.

EXAMPLE 16

Never-dried solvent-spun cellulose tow was treated firstly with an aqueous solution of sodium bicarbonate and secondly with an aqueous solution containing 100 g/l reagent SCVI, varying amounts of sodium bicarbonate and 10 g/l Matexil PAL, steamed for 5 minutes, rinsed with 0. 1% aqueous acetic acid and dried. This method of application of alkali is known for reactive dyestuffs and is called presharpening, although its significance in reducing fibrillation tendency has not heretofore been appreciated. Fibrillation tendency was assessed by Test Method 4 (blender). Experimental conditions and results are shown in Table 12:

TABLE 12

| Sodium Bicarbonate (g/l) | | |
|---|---|---|
| Presharpen Bath | Application Bath | Fibrillation Index |
| Control | | 4.8 |
| 20 | 0 | 0.1 |
| 5 | 15 | 3.9 |
| 10 | 10 | 1.7 |
| 10 | 20 | 3.9 |
| 0 | 20 | 0.3 |

The following Examples illustrate the use of coloured chemical reagents (dyestuffs) in the method of the invention.

EXAMPLE 17

In a first series of tests using dyes solvent-spun cellulose staple fibre was dyed, the dyed fibre processed into yarn by conventional spinning techniques, and the yarn woven into fabric for evaluation of the effect of the different dyes on fibrillation.

The details of the dyeing of the fibre sample were as follows:

In each case the fibre was pretreated before dyeing as follows:

2 g of fibre was first placed in a stainless steel cylinder approximately 25 cm high by 4 cm diameter. The cylinder had a capacity of approximately 250 ml, and at each step in the treatment 50 ml of solution was added to the 2 g of fibre.

The first step was to scour the fibre to remove the spinning lubricant. A conventional scouring solution of anionic detergent and $Na_2CO_3$ at 94° C. was added to the fibre, a screw cap was applied, and the capped cylinder was tumbled end-over-end for 45 minutes at about 60 tumbles per minute.

The scouring solution was then removed and the fibres were washed in water and bleached for 1 hour at 95° C. Again the cylinder was capped and tumbled at 60 tumbles per minute.

The bleaching solution used contained:

7.5 ml/l $H_2O_2$ (at 35% concentration)

1 g/l NAOH solid 1 g/l of a peroxide stabiliser and heavy metal sequestrant ("Contovan SNF" available from CHT Products Limited)

After bleaching, the fibres were washed and dyed using the dyes listed below. The dyeing procedures for each dye are also set out below.

TABLE I

| Dye | Dyes Used Colour Index | Reactive Group(s) |
|---|---|---|
| Procion Red MX-5B | Reactive Red 2 | Dichlorotriazine |
| Drimarene Red K-4BL | Reactive Red 147 | Fluorochloropyrimidine |
| Sumifix Supra Red 3BF | Reactive Red 195 | Vinyl sulphone/monochlorotriazine |
| Procion Red H8BN | Reactive Red 58 | Monochlorotriazine |
| Solar Red BA | Direct Red 80 | None |

(Procion is a Trade Mark of ICI plc. Drimarene and Solar are Trade Marks of Sandoz Ltd. Sumifix is a Trade Mark of Sumitomo Corporation.)

The application method for dyeing the fibre differed as to whether the fibres were dyed with reactive dyes or the direct dye. In the case of reactive dyes, the stainless steel cylinder containing the fabric was partially filled with a solution of dyestuff at a temperature in the range 25° to 30° C. 4% by weight dyestuff (on the weight of dry fibre used) was incorporated into the bath. The cylinder was then capped and tumbled end-over-end at about 60 tumbles per minute for 10 minutes. The cylinder was the . stopped and uncapped and sodium chloride was added at the rate of 50 to 80 g/l.

The cylinder was again capped and tumbled at 60 tumbles per minute for 10 minutes. The cap on the cylinder was loosened and the cylinder heated at a rate of 2° C. per minute until the dyeing temperature was reached. In the case of the Procion MX dye the temperature was raised to 30° C., in the case of Drimarene K the temperature was raised to 40° C., in the case of Procion H the temperature was raised to 80° C. and in the case of Sumifix Supra the temperature was raised to 60° C. After the specified temperature had been reached 5 to 20 g/l of sodium carbonate was added to the solution in the cylinder and the cylinder was again capped. The cylinder was then tumbled at 60 tumbles per minute for 60 minutes. The fibre was then removed from the cylinder and rinsed in clear water. The fibre was then replaced in the cylinder and washed with an anionic detergent for 15 minutes at 95° C. 2 g/l of anionic detergent was used. After the treatment with the detergent the fibre was rinsed with running water until the water ran clear.

In the case of the direct dye the cylinder was filled with a solution of dyestuff having 4% dyestuff by weight of dry fibre at a temperature of 40° C. The fibre was added, the cylinder capped and tumbled at 60 tumbles per minute for 10 minutes.

The cylinder was then loosely uncapped and heated to 95° C. at 2° C. per minute. The cylinder was recapped and tumbled for 10 minutes at 60 tumbles per minute after which 20 g/l of sodium chloride was added. After recapping, the cylinder was again tumbled at a rate of 60 tumbles per minute for 60 minutes.

The fibre was then removed from the cylinder and simply rinsed until the rinse water ran clear.

After dyeing and washing, the fibres were dried. The fibres were then assessed for the amount of fibrillation, fibre tenacity, fibre extensibility and water imbibition (W.I.). Tenacity (in centiNewton/tex) and extensibility (in per cent) were measured using conventional equipment, and again several samples (usually ten) were measured and an arithmetic mean calculated.

TABLE II

| Dye | Results Tenacity cN/tex | Extensibility % | W.I. % | Fibrillation Index |
|---|---|---|---|---|
| Procion Red MX-5B | 41.4 | 13.3 | 63.8 | 1.2 |
| Drimarine Red K-4BL | 41.8 | 14.0 | 63.5 | 0.9 |
| Sumifix Supra Red 3BF | 40.6 | 13.4 | 65.1 | 1.8 |
| Procion Red H8BN | 42.0 | 13.6 | 66.0 | 2.7 |
| Solar Red BA | 41.7 | 14.1 | 66.4 | 3.0 |
| Undyed Control | 40–42 | 13–15 | 63–65 | 3 |

The control sample was treated using the conditions described above for Direct Red 80, but without the use of any dyestuff in the dye bath.

From Table I it can be seen that three of the reactive dyes, namely Procion Red MX-5B, Drimarene Red K-4BL and Sumifix Supra Red 3BF, are bireactive dyes in the sense that each of these three dyes has two functional groups reactive with cellulose. In the case of the Procion Red Mx-5B dye there are two chlorine atoms on a triazine ring. In the case of the Drimarene Red dye there is one fluorine atom and one chlorine atom on a pyrimidine ring. In the case of the Sumifix Supra Red dye there is one chlorine atom and one vinyl sulphone group on the triazine ring. These three samples were therefore treated according to the method of the invention. In the case of the Procion Red H8BN dye, however, there is only one reactive functional group, namely a single chlorine atom on the triazine ring. In the case of the Solar Red BA Direct dye there is, of course, no reactive functional group at all. These two samples were therefore not treated according to the method of the invention.

Reviewing the figures in Table II, it can be seen that the all five dyes had very little effect on the tenacity, extensibility or water imbibition of the fibre compared to the undyed control fibre. Considering, however, the effect of the dyes on the fibrillation characteristics of the fibre it can be seen that the Direct dye gave effectively no reduction in fibrillation tendency at all compared to the undyed fibre. The Reactive Red 58 dye Procion Red H8BN—having a single reactive group—had very little effect on the fibrillation tendency of the fibre. In contrast, the three reactive dyes which are bireactive, namely Reactive Red 2 (Procion Red MXB), Reactive Red 147 (Drimarene Red K-4BL) and Reactive Red 195 (Sumifix Supra Red 3BF), all gave significant improvements in the resistance of the fibre to fibrillation. These improvements were, however, obtained as mentioned above without any significant effect on the other measured properties of the fibre.

EXAMPLE 18

Rather than being dyed in fibre form (whether in the dried or never dried state), solvent-spun cellulosic fibre may be spun into yarn, formed into fabric and then dyed as fabric. Alternatively, the yarn may be dyed as yarn.

The following dyeing trials were carried out on undyed fabric.

TABLE III

| Dye | Dyes Used Colour Index | Reactive Group(s) |
|---|---|---|
| Procion Blue MX-R | Reactive Blue 4 | Dichlorotriazine |
| Drimarene Blue K-BL | Reactive Blue 114 | Fluorochloro-pyrimidine |
| Procion Blue H-4R | Reactive Blue 74 | Monochlorotriazine |
| Solophenyl Blue A-GFL | Direct Blue 212 | None |

After dyeing by the same method as used for the corresponding Red dyes listed in Example 17, the fabrics were subjected to five cycles of a domestic wash at 60° C. each followed by tumble drying. The degree of fibrillation was then assessed and the samples ranked in order:

Drimarene Blue K-BL - No fibrillation
Procion Blue MX-R - No fibrillation
Procion Blue H-4R - High fibrillation
Solophenyl Blue A-GFL - High fibrillation Because the samples were in fabric form rather than in fibre form it was not possible to produce fibrillation indexes for the material. However, the two samples dyed with bireactive dyes, namely Drimarene Blue K-BL and Procion Blue MX-R, showed no fibrillation. The sample dyed with a monoreactive dye, namely Procion Blue H-4R, had a frosted appearance associated with a highly fibrillated material. Similarly, the fabric dyed with the direct dye Solophenyl Blue A-GFL was also highly fibrillated.

EXAMPLE 19

In a yet further series of tests, the same dyes and same conditions as in Example 18 were used to dye never-dried cellulosic fibres. Test results for tenacity, extensibility, water imbibition (W.I.) and Fibrillation Index are given in Table IV.

TABLE IV

| Dye | Test Results Tenacity cN/tex | Extensibility % | W.I. % | Fibrillation Index |
|---|---|---|---|---|
| Reactive Blue 4 | 41.1 | 13.1 | 64.3 | 1.3 |
| Reactive Blue 114 | 39.9 | 13.3 | 65.1 | 0.8 |
| Reactive 74 | 40.7 | 13.9 | 63.8 | 2.4 |
| Direct Blue 212 | 42.0 | 13.8 | 65.7 | 2.9 |

Again, it can be seen that the two samples dyed with the bireactive dyes Reactive Blue 4 and Reactive Blue 114 were very lightly fibrillated. The fibre dyed with the monoreactive dye Reactive Blue 74 was heavily fibrillated and the fibre dyed with the direct dye Direct Blue 212 was also heavily fibrillated. No significant differences in tensile properties or water imbibition were observed.

To further improve the appearance and handle of the fabric, it may be treated with cellulase enzymes, as illustrated below.

Cellulase enzymes work by cleaving the beta-1,4-glycoside bond in the cellulose converting it to soluble glucose.

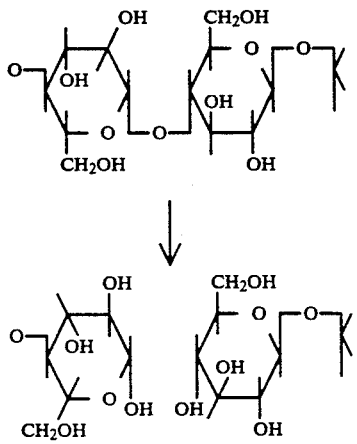

As a result of this hydrolytic effect, the fabric becomes smooth due to loss of the surface fibre and the handle becomes softer. This hydrolytic effect will also result in a negative effect on fabric strength.

On solvent-spun cellulose fabrics, cellulase enzymes have been found to be extremely effective at removing fibrillation that has occurred during the dyeing process.

A number of cellulase enzymes were tested on a badly fibrillated solvent-spun cellulose woven fabric. The effectiveness of each enzyme was numerically assessed by carrying out a colour difference measurement before and after treatment. The higher the total colour difference (DE) the more effective the treatment due to removal of the apparently white surface fibrils.

The system is most applicable on a batchwise system as the mechanical agitation of a winch or jet machine is beneficial at removing loose fibres.

TABLE V

Standard process: x% by weight cellulase
0.75 g/l Rucogen SAS (nonionic detergent)
pH set as required
60 mins 55–60° C.

| Enzyme | pH | Max Conc | DE | Manufacturer |
|---|---|---|---|---|
| Cytolase 123 | 4.8 | 1.5% | 1.4 | Genencor |
| Rucolase CEL | 4.8 | 1.0% | 1.3 | Rudolf |
| Celluclast | 4.8 | 1.0% | 1.0 | Novo |

All the above enzymes are-acid activated. The maximum concentrations quoted are maximum percentages by weight of enzyme that have been found to be able to be used without resulting in a strength loss of greater than 10%. Strength losses of up to 30% can occur with high enzyme concentration and extended treatment times, but this may make the fabric unacceptably weak for many applications.

Two neutral activated systems were also evaluated. These have the advantage that strength losses are very low (less than 5%) even at high concentrations of cellulase enzymes but the effectiveness at removing fibrillation is reduced.

| Enzyme | Conc (wt) | DE | Manufacturer |
|---|---|---|---|
| Deltazyme | 3% | 0.9 | Rexodan |
| Denimax | 3% | 0.85 | Novo |

The following characteristics of the process have been determined by these trials:

i) Acid-activated enzymes display much higher activity than their neutral counterparts.

ii) Concentrations and times should be carefully controlled to prevent excessive strength losses.

iii) Every fabric will be affected to a lesser or greater degree; preliminary trials should be carried out to define the degree of fibre loss that will yield a smoother, softer product and still maintain adequate strength.

iv) Inclusion of a nonionic detergent assists action.

Enzyme treatment is preferably carried out as a discrete step, which makes the control of pH, time and temperature easier to achieve.

The cellulase enzyme treatment may also be carried out on undyed solvent-spun material, or on solvent-spun material not treated with a chemical reagent having two to six functional groups per molecule reactive with cellulose.

I claim:

1. A process for fibre treatment comprising contacting solvent-spun cellulose fibre with an aqueous system comprising a substantially colourless chemical reagent having two to six functional groups reactive with cellulose and drying said fibre to reduce the fibrillation tendency of said fibre.

2. A process for fibre treatment comprising contacting solvent-spun cellulose fibre with an aqueous system which comprises a chemical reagent having two to six functional groups reactive with cellulose and drying said fibre to reduce the fibrillation tendency of said fibre, said fibre being of substantially the same colour before and after said contacting and drying steps.

3. The process according to claim 1 wherein each said functional group is a vinyl sulphone group.

4. A process according to claim 1 wherein the chemical reagent contains at least one ring having at least two functional groups reactive with cellulose attached thereto.

5. A process according to claim 5 wherein the or each ring is selected from the group consisting of pyridazine, pyrimidine and sym-triazine rings.

6. A process according to claim 5 wherein at least one of the functional groups reactive with cellulose is attached directly to the ring and is an element selected from the group consisting of fluorine, chlorine and bromine.

7. A process according to claim 4 wherein at least one of the functional groups reactive with cellulose is selected from the group consisting of a vinyl sulphone group and precursors thereof.

8. A process according to claim 2 wherein the chemical reagent contains at least one ring having at least two functional groups reactive with cellulose attached thereto.

9. A process according to claim 2 wherein the chemical reagent contains one ring having two or three functional groups reactive with cellulose attached thereto.

10. A process according to claim 8 wherein the or each ring is a polyazine ring.

11. A process according to claim 10 wherein the or each ring is selected from the group consisting of pyridazine, pyrimidine and sym-triazine rings.

12. A process according to claim 10 wherein at least one of the functional groups reactive with cellulose is a fluorine, chlorine or bromine atom attached directly to the ring.

13. A process according to claim 10 wherein the chemical reagent contains a dichlorotriazinyl, trichloropyrimidinyl, chlorodifluoropyrimidinyl, dichloropyrimidinyl, dichloropyridazinyl, dichloropyridazinonyl, dichloroquinoxalinyl or dichlorophthalazinyl group.

14. A process according to claim 2 wherein at least one of the functional groups reactive with cellulose is a vinyl sulphone group or precursor thereof.

15. A process according to claim 2 wherein the chemical reagent contains a solubilising group to enhance its solubility in water.

16. A process according to claim 15 wherein the solubilising group is a sulphonic acid group or an oligomeric poly(ethylene glycol) or poly(propylene glycol) chain.

17. A process according to claim 2 wherein the fibre is treated with 0.1 to 10% by weight of the chemical reagent.

18. A process according to claim 2 wherein the fibre is treated with 0.2 to 5% by weight of the chemical reagent.

19. A process according to claim 2 wherein the fibre is treated with 0.2 to 2% by weight of the chemical reagent.

20. A process according to claim 2 wherein said aqueous system is an aqueous solution.

21. A process according to claim 20 wherein the aqueous solution of the chemical reagent is applied to never-dried solvent-spun cellulose fibre.

22. A process according to claim 20 wherein the aqueous solution of the chemical reagent is applied to solvent-spun cellulose fibre which has previously been dried.

23. A process according to claim 20 wherein the fibre is treated with the aqueous solution of the chemical reagent under mildly alkaline conditions.

24. A process according to claim 23 wherein the fibre is treated with a mildly alkaline aqueous solution before treatment with the solution of the chemical reagent.

25. A process according to claim 24 wherein the solution of the chemical reagent contains no added alkali.

26. A process according to claim 20 wherein the treated fibre is heated to induce a substantial degree of reaction between the cellulose and the functional groups reactive with cellulose.

27. A process according to claim 26 wherein the treated fibre is heated using steam.

28. A process according to claim 27 wherein the treated fibre is heated using steam at a temperature of 100° to 110° C. for 4 seconds to 20 minutes.

29. A process according to claim 7 wherein the treated fibre is subsequently treated with an aqueous solution of a cellulase enzyme.

30. A solvent-spun cellulose fibre having a reduced fibrillation tendency produced by the process of contacting said fiber with an aqueous solution of a substantially colourless chemical reagent having two to six functional groups reactive with cellulose so as to reduce the fibrillation tendency of the fibre.

31. A process for the manufacture of solvent-spun cellulose fibre with a reduced fibrillation tendency comprising the steps of:

(a) dissolving cellulose in a solvent to form a solution, the solvent being miscible with water;

(b) extruding the solution through a die to form a fibre precursor;

(c) passing the fibre precursor through at least one water bath to remove the solvent and form the fibre (d) contacting the fibre with a solution of a substantially colourless chemical reagent having two to six functional groups reactive with cellulose; and (e) drying the treated fibre.

32. A process according to claim 31 wherein the solvent is a tertiary amine N-oxide.

33. A process according to claim 32 wherein the solvent is N-methylmorpholine N-oxide.

* * * * *

UNITED STATES PATENT AND TRADEMARK OFFICE

CERTIFICATE OF CORRECTION

PATENT NO. : 5,310,424

DATED : May 10, 1994

INVENTOR(S) : James M. Taylor

It is certified that error appears in the above-identified patent and that said Letters Patent is hereby corrected as shown below:

Col. 19, Claim 5, line 1, delete "5" and insert in place thereof -- 4 --.

Col. 20, Claim 29, delete "7" and insert in place thereof -- 2 --.

Signed and Sealed this

Fourteenth Day of July, 1998

Bruce Lehman

*Attest:*

BRUCE LEHMAN

*Attesting Officer*

*Commissioner of Patents and Trademarks*

US005310424B1

REEXAMINATION CERTIFICATE (3476th)

United States Patent [19]

Taylor

[11] B1 5,310,424

[45] Certificate Issued Apr. 7, 1998

[54] PROCESS FOR REDUCING THE FIBRILLATION TENDENCY OF SOLVENT-SPUN CELLULOSE FIBRE

[75] Inventor: James M. Taylor, Derby, United Kingdom

[73] Assignee: Courtaulds PLC, London, United Kingdom

Reexamination Request:
No. 90/004,515, Jan. 13, 1997

Reexamination Certificate for:

| | |
|---|---|
| Patent No.: | **5,310,424** |
| Issued: | **May 10, 1994** |
| Appl. No.: | **863,008** |
| Filed: | **Apr. 6, 1992** |

[30] Foreign Application Priority Data

Oct. 21, 1991 [GB] United Kingdom ..... 9122318

[51] Int. Cl.[6] ..... D06M 13/322

[52] U.S. Cl. ..... 8/190; 8/189; 8/549; 8/116.1; 8/181; 8/191; 8/193; 8/120; 8/125; 8/186

[58] Field of Search ..... 8/116.1, 181, 189, 8/190, 191, 193, 120, 125, 186, 549

[56] References Cited

U.S. PATENT DOCUMENTS

| | | | |
|---|---|---|---|
| 2,826,514 | 3/1958 | Schroeder . | |
| 2,892,674 | 6/1959 | Sause et al. . | |
| 2,971,815 | 2/1961 | Bullock . | |
| 3,294,778 | 12/1966 | Randall et al. . | |
| 3,400,127 | 9/1968 | Tesoro . | |
| 3,441,954 | 4/1969 | Tesoro et al. | 8/189 |
| 3,574,522 | 4/1971 | Rowland et al. . | |
| 3,606,990 | 9/1971 | Gobert . | |
| 3,663,159 | 5/1972 | Gordon . | |
| 3,849,169 | 11/1974 | Cicione et al. . | |
| 3,849,409 | 11/1974 | Weil . | |
| 3,954,405 | 5/1976 | North et al. . | |
| 3,958,932 | 5/1976 | Rowland et al. . | |
| 3,960,983 | 6/1976 | Blank . | |
| 4,090,844 | 5/1978 | Rowland . | |
| 4,125,652 | 11/1978 | Komminoth et al. . | |
| 4,185,961 | 1/1980 | Denzik . | |
| 4,268,266 | 5/1981 | Hendricks . | |
| 4,277,243 | 7/1981 | Rowland . | |
| 4,283,196 | 8/1981 | Wenghoefer . | |
| 4,336,023 | 6/1982 | Warburton . | |
| 4,371,517 | 2/1983 | Vanlerberghe . | |
| 4,443,355 | 4/1984 | Murata et al. | 510/320 |
| 4,472,167 | 9/1984 | Welch . | |
| 4,483,689 | 11/1984 | Welch . | |
| 4,502,866 | 3/1985 | Brenneisen . | |
| 4,629,470 | 12/1986 | Harper . | |
| 4,780,102 | 10/1988 | Harper . | |
| 4,880,430 | 11/1989 | Schleusener . | |
| 4,880,431 | 11/1989 | Yokogawa et al. . | |
| 4,908,097 | 3/1990 | Box . | |
| 4,971,708 | 11/1990 | Lee et al. . | |
| 4,999,149 | 3/1991 | Chen . | |
| 5,085,668 | 2/1992 | Pelster et al. . | |
| 5,131,917 | 7/1992 | Miyamoto et al. . | |
| 5,311,389 | 5/1994 | Howey . | |
| 5,328,757 | 7/1994 | Kenney et al. . | |
| 5,403,530 | 4/1995 | Taylor . | |
| 5,445,652 | 8/1995 | Connell et al. . | |

FOREIGN PATENT DOCUMENTS

| | | |
|---|---|---|
| 787/93 | 5/1994 | Australia . |
| 044172 | 1/1982 | European Pat. Off. . |
| 252649 | 1/1988 | European Pat. Off. . |
| 1148892 | 12/1957 | France . |
| 1158775 | 6/1958 | France . |
| 1565248 | 4/1969 | France . |
| 1576514 | 8/1969 | France . |
| 2450293 | 9/1980 | France . |
| 1444127 | 9/1969 | Germany . |
| 576270 | 3/1946 | United Kingdom . |
| 810352 | 3/1959 | United Kingdom . |
| 878655 | 10/1961 | United Kingdom . |
| 936399 | 9/1963 | United Kingdom . |
| 950073 | 2/1964 | United Kingdom . |
| 953171 | 3/1964 | United Kingdom . |
| 985150 | 3/1965 | United Kingdom . |
| 989873 | 4/1965 | United Kingdom . |
| 1142428 | 2/1969 | United Kingdom . |
| 2007147 | 5/1979 | United Kingdom . |
| 2284177 | 5/1995 | United Kingdom . |

OTHER PUBLICATIONS

C. Overberger et al. "A Convenient Synthesis of Vinyl Sulfone", J. Org. Chem., 18:1486 (1954) (Month Unknown).

Dictionary of Organic Compounds, 4th edition, vol. 2, p. 996 (Eyre and Spottiswood, 1965) (Month Unknown).

Kirk–Othmer Encyclopaedia of Chemical Technology, 4th edition, vol. 6, pp. 140–142 and 151–152 (Wiley–Interscience, 1993) (Month Unknown).

Kirk–Othmer Encyclopaedia of Chemical Technology, 4th edition, vol. 5, p. 797 (Wiley–Interscience, 1993) (Month Unknown).

M. Eibl, "Vernetzung von Lenzing Lyocell", Lenzinger Berichte, Jul. 6, 1997, pp. 112–114 (May, 1997) (Month Unknown).

U.S. Patent Application No. 501,418, dated Aug. 28, 1974 (NTIS) (Abstract only), Chemical Abstract #CA84(10):61114w.

International Patent Application No. WO81/03274, published Nov. 26, 1981 (Abstract only), WPI Acc NO. 81–87583D/48.

(List continued on next page.)

*Primary Examiner*—Alan D. Diamond

[57] ABSTRACT

A process is disclosed for providing a solvent-spun cellulose fiber with a reduced fibrillation tendency. The fiber is treated with a chemical reagent, preferably substantially colorless, having 2 to 6 functional groups reactive with cellulose, suitably dissolved in an aqueous solution.

European Patent Application No. 437 816, published Jul. 24, 1991 (Abstract only), Chemical Abstract #CA115(14):137898m.
German Patent Application No. 2,249,321, published May 2, 1974 (Abstract only) CA81(24):154487y.
German Patent Application No. 2,242,939, published Mar. 15, 1973 (Abstract only) CA78(24):148935g.
German Patent Application No. 2,209,939, published Sep. 6, 1973 (Abstract only) CA80(10):492476.
Great Britain Patent Application No. 2,103,639, published Nov. 14, 1984 (Abstract only) WPI Acc No. 83-18052k/08.
Great Britain Patent Application No. 1,354,406, published May 30, 1974 (Abstract only) Chemical Abstract No. CA81(22):137226bv.
East German Patent Application No. 236,581, published Jun. 11, 1986 (Abstract only) Chemical Abstract No. CA107(22):200331y.
German Patent Application No. 2,118,224, published Nov. 2, 1972 (Abstract only) CA78(14):85867w.
German Patent Application No. 2,111,038, published Sep. 28, 1972 (Abstract only) CA78(10):59734f.
Poland Patent Application No. 71100, published Sep. 30, 1976 (Abstract only) CA90(8):56271q.
Soviet Union Patent Application No. 465384, published Oct. 20, 1975 (Abstract only) WPI Acc No. 76-33492x/18.
Switzerland Patent Application No. 543484, published Dec. 14, 1973 (Abstract only) WPI Acc No. 71-13695/07.
Australian Patent Application No. 40,668,78, published Apr. 17, 1980 (Abstract only) (corres. to French Patent Application No. 2,407,280, published May 25, 1979).
Japanese Patent Application No. 3197128, published Aug. 28, 1991 (Abstract only) WPI Acc No. 91-126736/18.
Japanese Patent Application No. 1297430, published Nov. 30, 1989 (Abstract only) WPI Acc No. 90-018251/03.
Japanese Patent Application No. 1271238, published Oct. 30, 1989 (Abstract only) WPI Acc No. 89-361999/49.
Japanese Patent Application No. 1239167, published Sep. 25, 1989 (Abstract only) JAPIO vol. 13 No. 575.
Japanese Patent Application No. 89000505, published Jan. 6, 1989 (Abstract only) WPI Acc No. 87-105590/15.
Japanes Patent Application No. 87057744, published Dec. 2, 1987 (Abstract only) WPI Acc No. 81-46896D/26.
Japanese Patent Application No. 62210054, published Sep. 16, 1987 (Abstract only) WPI Acc No. 87-301795/43.
Japanese Patent Application No. 53122880, published Oct. 26, 1978 (Abstract only) CA90(12):88689y.
Japanese Patent Application No. 53078377, published Jul. 11, 1978 (Abstract only) CA 89(22):181174r.
Japanese Patent Application No. 53,035,017, published Apr. 1, 1978 (Abstract) Derwent 78-34472A.
Japanese Patent Application No. 52141843, published Nov. 26, 1977 (Abstract only).
Japanese Patent Application No. 77039479, published Oct. 5, 1977 (Abstract only) CA 88(22):153885j.
Japanese Patent Application No. 77033718, published Aug. 30, 1977 (Abstract only) WPI Acc No. 75-15019W/09.
Japanese Patent Application No. 52070187, published Jun. 10, 1977 (Abstract only) CA87(16): 119198g.
Japanese Patent Application No. 51035786, published Mar. 26, 1976 (Abstract only) CA85(10):64703u.
Japanese Patent Application No. 50112599, published Sep. 4, 1975 (Abstract only) CA84(8):46016x.
Japanese Patent Application No. 50112598, published Sep. 4, 1975 (Abstract only) CA84(8) 46017y.
Japanese Patent Application No. 50017593, published Jun. 21, 1975 (Abstract only) CA84(24):166157r.
Japanese Patent Application No. 49080392, published Aug. 2, 1974 (Abstract only) WPI Acc No. 75-15019W/09.
Japanese Patent Application No. 49001870, published Jan. 9, 1974 (Abstract only) CA82(24):157736k.
Japanese Patent Application No. 48092668, published Dec. 1, 1973 (Abstract only) CA80(26):146933e.
Japanese Patent Application No. 48015234, published May 12, 1973 (Abstract only) CA89(10):49149w.
R. Harper, "Crosslinking, Grafting and Dyeing: Finishing for Added Properties", *Textile Chemist and Colorist*, 23(11):15-20 (Nov., 1991).
"New Generation of Cellulose Fibers", *Melliand Textilberichte/International Textile Reports*, 72(2):94, Textile Technol. Dig. No. 03135/91 (Abstract) (Feb., 1991).
"Lenzing Opens Solvent-Spinning Line for Cellulose Fibres", *Nonwovens Rep. Int.*, 237:6-7, Pira Abstract No. 07-91-00562 (Abstract) (Dec., 1990).
E. Flick, "Textile Finishing Chemicals, An Industrial Guide", p. 372 (Mar., 1990).
"Radiopaque Polymers to Safety", *Encyclopedia of Polymer Science and Engineering*, vol. 14, pp. 45-46, 57-59, John Wiley & Sons, Inc. (1988) (month unknown).
S. Anand et al, "The Dimensional Properties of Single-Jersey Loop-Pile Fabrics, Part II: Studies of Fabrics with Textured Continuous-filament Yarns in the Ground Structure", *J. Text. Inst.*, 5:349 (1987) (month unknown).
H. Petersen, "The Chemistry of Crease-Resist Crosslinking Agents", *Rev. Prog. Coloration*, 17:7-22 (1987) (month unknown).
Ullmann's Encyclopedia of Industrial Chemistry, Fifth, Completely Revised Edition, vol. A10: "Ethanolamines to Fibers, 4. Synthetic Organic", Section 4.2.2. Washing and Finishing, VCH (Weinheim, 1987) (month unknown).
P. Pavlov et al, "Properties of Viscose Fibres Modified in an As-spun State by Cross-Linking", *J. Textile Institute*, 78(5) :357-361 (Sep.-Oct., 1987).
R. Rosenthal, "Genesis" Fiber Developed by Courtaulds, *Nonwovens Ind.*, 17(8) :33, Paperchem No. 57-06976 (Abstract) (Aug., 1986).
"Textiles (Finishing)" in *Kirk-Othmer, Encyclopedia of Chemical Technology*, 3rd edition, vol. 22 -(Sulfonation and Sulfation to Thorium and Thorium Compounds), pp. 769-790 (1983) (month unknown).
H. Nasr et al, "Wood Blends with Improved Dyeability and Stain-release Properties Through Gamma Ray Induced Grafting", *Kolor. Ert.*, 23(2-3) :55-64 (1981) (Abstract) [Nasr I] (month unknown).
A. Hebeish et al., "Chemical Modification of Cotton Through Reaction with Alkoxy Adducts of Acrylamide and Hexahydro-1,3,5-triacryloyl-s-triazine in Nonaqueous Medium", *Angew. Makromol. Chem.*, 91:77-97 (1980) (abstract) (month unknown).
M. El-Kashouti et al, "Utilization of Hexahydro-1,3,5-triacryloyl-s-triazine in Cotton Printing", *Cellul. Chem. Technol.*, 12(2) :223-229 (1978) (Abstract) (month unknown).
S. Rowland et al, "Polymerization-crosslinking of N-methylolacrylamide in Cottpon Fabric", *Text. Res. J.*, 48(2):73-80 (1978) (Abstract) [Rowland I] (month unknown).
M. Solarz et al, "Wrinkle-resistant Finishing of Cellullose Fabrics in an Alkaline Medium with Simultaneous Dyeing with Acid Dyes", *Przegl. Wlok.*, 31(1) :28-31 (1977) (Abstract) [Solarz I] (month unknown).

M. Solarz, "Modification of Cellulose Fibers with N,N'-methylenebisacrylamide", *Przegl. Wlok.*, 30(11-12): 546-549 (1976) (Abstract) [Solarz II] (month unknown).
J. Arthur, "Photofinishing for Cotton Textiles", *U. S., Agric. Res. Serv., South. Reg.*, ARS-S-64, 6-7 (1975) (Abstract) (month unknown).
M. Kamel et al, "Creation of Reactive Centers for Cotton, VII., Mechanism of Reaction of Cotton with Hexahydro-1, 3,5-triacryloxyl-s-triazine", *Text. Res. J.*, 45(11):800-804 (1975) (Abstract) [Kamel I] (month unknown).
M. Kamel et al, "Creation of Reactive Centers on Cotton, III., Synthesis of Some New Methylolacrylamide Derivatives", *Kolor. Ert.*, 17(7-8):217-224 (1975) (Abstract) [Kamel II] (month unknown).
J. Bogdanski, "Binding of Cellulose Xanthation by-products with Hexahydro-1,3,5-triacryloyltriazine", *Zesz. Nauk. — Akad. Ekon. Poznaniu, Ser. 1*, 58:143-146 (1974) (Abstract) (month unknown).
H. Nasr, "Radiation Modification of Cotton Fabrics, II., Catalytic Effect of Grafted Acids", *Text Res. J.*, 43(10):607-608 (1973) (Abstract) [NASR II] (month unkown).
H. Nasr, "Radiation Modification of Cotton Fabrics, I., Crosslinking Cotton Using Multifunctional Monomers", *Text. Res. J.*, 42(8):497-499 (1972) (Abstract) [NASR III] (month unknown).
A Wawrzyniak, "Dyeing Cellulose Fibers with azo Dyes Coupled to the Fiber Through a Reactive Intermediate", *Przegl. Wlok.*, 26(6):337-347 (1972) (Abstract) [Wawrzyniak I] (month unknown).
M. Kamel et al, "Dye Fixation Using Hexahydro-1,3,5-triacryloyl-s-triazine", *Amer. Dyest. Rep.*, 60(3):33-34, 38, 40, 42 (1971) (Abstract) [Kamel III] (month unknown).
G. Valk et al, "Creation of Reactive Centers on Cellulose Using Hexahydro-1,3,5-triacryloyl-s-triazine", *Text. Res. J.*, 41(4):364 (1971) (Abstract) [Valk I] (month unknown).
A. Wawrzyniak et al, "Nature of the Chemical Reaction Between an ANionic Dye and Cellulose in the Presence of a Free Reactive System", *Przegl. Wlok.*, 25(12):647-653 (1971) (Abstract) [Wawrzyniak II] (month unknown).
R. Moncrieff, "Man-Made Fibres", 5th ed. p. 211 (1970) (month unknown).
S. Rowland et al, "Reaction of Activated Vinyl Compounds with Cotton Cellulose via Internal Catalysis", *J. Appl. Polym. Sci.*, 14(2):441-452 (1970) (Abstract) [Rowland II] (month unknown).
F. Schlaeppi et al, "Fixation of Dyes by High Energy Irradiation" *Text. Chem. Color.*, 2(24):414-424 (1970) (Abstract) (month unknown).
G. Valk et al, "Analysis of High-Grade Finishes, 7., Chemical Detection of the Cross-linking of Cotton with N-acrylamide Derivatives", *Melliand Textilber.*, 51(6):714-719 (1970) (Abstract) [Valk II] (month unknown).
M. Chekalin et al, "Fixation of Dyes Containing Labile Hydrogen on Cotton Fabrics by Means of Polyfunctional Compounds", *Tekst. Prom. (Moscow)*, 28(9):40-43 (1968) (Abstract) (month unknown).
"Man-Made Fibers Science and Technology", vol. 2, p. 33, Interscience Publishers (1968) (month unknown).
J. Marsh, "An Introduction to Textile Finishing", 2d ed., Chapman and Hall Ltd. (London, 1966) (month unknown).
M. Dube and R. Blackwell, "Precipitation and Crystallisation of Cellulose from Amine Oxide Solutions", *Proceedings of the Technical Association of the Pulp and Paper Industry*, 1983 Dissolving and Specialty Pulps Conference, TAPPI Press pp. 111-119 (1983) (month unknown).
"Styrene Polymers to Toys" *Encyclopedia of Polymer Science and Engineering*, vol. 16, pp. 684-685 Wiley-Interscience (1989) (month unknown).
M. Hurwitz et al, "Dialdehydes as Cotton Cellulose Cross-Linkers", *Textile Research Journal*, 28(3):257-262 (Mar.,1958) (month unknown).

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 4–7, 21, 22, 26, 30 and 31 are cancelled.

Claims 3, 8, 9, 12–20, 27, 29, 32 and 33 are determined to be patentable as amended.

Claims 10, 11, 23–25 and 28, dependent on an amended claim, are determined to be patentable.

New claims 34–40 are added and determined to be patentable.

3. The process according to claim [1] *34* wherein each said functional group is a vinyl sulphone group.

8. [A] *The* process according to claim [2] *34* wherein the chemical reagent contains at least one ring having at least two functional groups reactive with cellulose attached thereto.

9. [A] *The* process according to claim [2] *34* wherein the chemical reagent contains one ring having two or three functional groups reactive with cellulose attached thereto.

12. A process [according to claim 10] *for reducing the fibrillation tendency of solvent-spun cellulose fibre comprising the steps of:*

(*a*) *contacting never-dried solvent-spun cellulose fibre under alkaline conditions with an aqueous system which comprises a chemical reagent having two to six functional groups reactive with cellulose, said reagent containing at least one polyazine ring having at least two of said functional groups attached thereto,* wherein at least one of [the] *said* functional groups [reactive with cellulose] is a fluorine, chlorine or bromine atom attached directly to [the] *said* ring, *and*

(*b*) *drying said fibre to reduce the fibrillation tendency of said fibre, said fibre being of substantially the same color before and after said contacting and drying steps.*

13. A process [according to claim 10 wherein the chemical reagent contains] *for reducing fibrillation tendency of solvent-spun cellulose fibre comprising the steps of:*

(*a*) *contacting never-dried solvent-spun cellulose fibre under alkaline conditions with an aqueous system which comprises a chemical reagent having two to six functional groups reactive with cellulose said reagent containing* a dichlorotriazinyl, trichloropyrimidinyl, chlorodifluoropyrimidinyl, dichloropyrimidinyl, dichloropyridazinyl, dichloropyridazinoyl, dichloroquinoxalinyl or dichlorophthalazinyl group, *and*

(*b*) *drying said fibre to reduce the fibrillation tendency of said fibre, said fibre being of substantially the same colour before and after said contacting and drying steps.*

14. [A] *The* process according to claim [2] *34* wherein at least one of the functional groups reactive with cellulose is a vinyl sulphone group or precursor thereof.

15. [A] *The* process according to claim [2] *34* wherein the chemical reagent contains a solubilising group to enhance its solubility in water.

16. A process [according to claim 15 wherein the] *for reducing the fibrillation tendency of solvent-spun cellulose fibre comprising the steps of:*

(*a*) *contacting never-dried solvent-spun cellulose fibre under alkaline conditions with an aqueous system which comprises a chemical reagent having two to six functional groups reactive with cellulose, said reagent containing to enhance its solubility in water a* solubilising group [is a] *selected from the group consisting of* sulphonic acid [group or an] *groups,* oligomeric poly(ethylene glycol) [or] *chains and* poly(propylene glycol) chains, *and*

(*b*) *drying said fibre to reduce the fibrillation tendency of said fibre, said fibre being of substantially the same colour before and after said contacting and drying steps.*

17. [A] *The* process according to claim [2] *34* wherein the fibre is treated with 0.1 to 10% by weight of the chemical reagent.

18. [A] *The* process according to claim [2] *34* wherein the fibre is treated with 0.2 to 5% by weight of the chemical reagent.

19. [A] *The* process according to claim [2] *34* wherein the fibre is treated with 0.2 to 2% by weight of the chemical reagent.

20. [A] *The* process according to claim [2] *34* wherein said aqueous system is an aqueous solution.

27. A process [according to claim 26 wherein the treated] *for reducing the fibrillation tendency of solvent-spun cellulose fibre comprising the steps of:*

(*a*) *contacting never-dried solvent-spun cellulose fibre under alkaline conditions with an aqueous solution which comprises a chemical reagent having two to six functional groups reactive with cellulose,*

(*b*) *heating said* fibre [is heated] using steam *to induce a substantial degree of reaction between said cellulose and said functional groups reactive with cellulose and*

(*c*) *drying said fibre to reduce the fibrillation tendency of said fibre, said fibre being of substantially the same colour before and after said contacting and drying steps.*

29. [A] *The* process according to [claim 7] *any of* claims *34, 35 or 36* wherein the treated fibre is subsequently treated with an aqueous solution of a cellulase enzyme.

32. [A] *The* process according to [claim 31] *any of* claims *12, 13, 16, 27, 34, 35 or 36* wherein the solvent is a tertiary amine N-oxide.

33. [A] *The* process according to [claim 22] *any of* claims *12, 13, 16, 27, 34, 35 or 36* wherein the solvent in N-methylmorpholine N-oxide.

*34. A process for reducing fibrillation tendency of solvent-spun cellulose fibre comprising the steps of:*

(*a*) *contacting never-dried solvent-spun cellulose fibre under alkaline conditions with an aqueous system comprising a substantially colourless chemical reagent having from two to six functional groups reactive with cellulose;*

(*b*) *steaming said contacted fibre to induce a substantial degree of reaction between said fibre and said functional groups; and*

(*c*) *drying said steamed fibre,*

*whereby said fibre is of substantially the same colour both before and after steps* (*a*), (*b*), *and* (*c*), *and whereby the fibrillation tendency of said fibre is reduced.*

*35. The process according to claim 34, wherein the steaming is at a temperature of 100° to 110° C. for 4 seconds to 20 minutes.*

*36. A process for the manufacturing of solvent-spun cellulose fibre with a reduced fibrillation tendency comprising the steps of:*

*(a) dissolving cellulose in a solvent miscible in water to form a solution;*

*(b) extruding the solution through a die to form a fibre precursor;*

*(c) passing the fibre precursor through at least one water bath to remove the solvent and form the fibre;*

*(d) drying the fibre; and*

*(e) applying to the fibre under alkaline conditions an aqueous solution of a substantially colourless chemical reagent having two to six functional groups reactive with cellulose, said reagent containing at least one polyazine ring, wherein each said polyazine ring has at least two of said functional groups attached thereto, and wherein each said polyazine ring has directly attached thereto at least one functional group which is an element selected from the group consisting of fluorine, chlorine and bromine, whereby from 0.2 to 2.0%* by weight of said reagents is applied to said fibre.

*37. The process according to claim 34 or 36 wherein said reagent contains a dichlorotriazinyl, trichloropyrimidinyl, chlorodifluoropyrimidinyl, dichloropyrimidinyl, dichloropyridazinyl, dichloropyridazinoyl, dichloroquinoxalinyl or dichlorophthalazinyl group.*

*38. A process for the manufacturing of solvent-spun cellulose fibre with a reduced fibrillation tendency comprising the steps of:*

*(a) dissolving cellulose in a solvent miscible with water to form a solution:*

*(b) extruding the solution through a die to form a fibre precursor;*

*(c) passing the fibre precursor through at least one water bath to remove the solvent and form the fibre;*

*(d) drying the fibre; and*

*(e) applying to the fibre under alkaline conditions an aqueous solution of a substantially colourless chemical reagent having two to six functional groups reactive with cellulose said reagent containing to enhance its solubility in water a solubilising group selected from the group consisting of sulphonic acid groups, oligomeric poly(ethylene glycol) chains and oligomeric poly (propylene) glycol chains, whereby from 0.2 to 2.0* by weight of said reagent is applied to said fibre.

*39. A process for the manufacture of solvent-spun cellulose fibre with a reduced fibrillation tendency comprising the steps of:*

*(a) dissolving cellulose in a solvent to form a solution, the solvent being miscible with water;*

*(b) extruding the solution through a die to form a fibre precursor;*

*(c) passing the fibre precursor through at least one water bath to remove the solvent and form the fibre;*

*(d) drying the fibre; and*

*(e) applying to the fibre under alkaline conditions an aqueous solution of a substantially colourless chemical reagent having two to six functional groups reactive with cellulose; and*

*(f) heating the fibre using steam to induce a substantial degree of reaction between the cellulose and the functional groups whereby from 0.2 to 2.0%* by weight of said reagent is applied to said fibre.

*40. The process according to claim 39 wherein the fibre is heated using steam at a temperature of 100° to 110° C. for 4 seconds to 20 minutes.*

* * * * *